US005454700A

United States Patent [19]

Iguchi et al.

[11] Patent Number: 5,454,700

[45] Date of Patent: Oct. 3, 1995

[54] BEARING SUPPORT FOR A LYSHOLM COMPRESSOR

[75] Inventors: Yuichi Iguchi, Tokyo; Shigeru Takabe, Machida; Hidetsugu Matsubara, Hachioji; Tsuyoshi Goto; Hiroyuki Sugimoto, both of Hiroshima; Yoshiyuki Miyagi, Ichikawa, all of Japan

[73] Assignees: Ishikawajima-Harima Jukogyo Kabushiki Kaisha, Tokyo; Mazda Motor Corporation, Hiroshima, both of Japan

[21] Appl. No.: 233,429

[22] Filed: Apr. 28, 1994

[30] Foreign Application Priority Data

May 8, 1993 [JP] Japan ..... 5-131100
May 8, 1993 [JP] Japan ..... 5-131101

[51] Int. Cl.[6] ..... F01C 1/16; F16C 27/00

[52] U.S. Cl. ..... 418/201.1; 384/493

[58] Field of Search ..... 418/201.1, 202; 384/493, 537

[56] References Cited

U.S. PATENT DOCUMENTS 3,910,731 10/1975 Persson et al. ..... 418/201.1
4,065,190 12/1977 Hallerback ..... 384/493
4,080,119 3/1978 Eriksson ..... 418/201.1
4,465,446 8/1984 Nemit, Jr. et al. ..... 418/201.1
5,269,667 12/1993 Mauney ..... 418/201.1

OTHER PUBLICATIONS

Japanese Patent 1st Publication No. 3–92542 (Laid Open on Apr. 17, 1991).

*Primary Examiner*—Richard A. Bertsch
*Assistant Examiner*—Charles G. Freay
*Attorney, Agent, or Firm*—Oblon, Spivak, McClelland, Maier, & Neustadt

[57] ABSTRACT

In a lysholm compressor having intermeshing male and female rotors rotated in a casing to compress an axially flowing gas, discharge-side shafts of the rotors are borne by discharge-side bearings to fix the discharge-side shafts in thrust direction while suction-side shafts of the rotors are borne by suction-side bearings to allow the suction-side shafts to move in the thrust direction. Clearances of the rotors to the casing are properly set or selected.

6 Claims, 5 Drawing Sheets

BEARING SUPPORT FOR A LYSHOLM COMPRESSOR

BACKGROUND OF THE INVENTION

The present invention relates to a Lysholm compressor.

FIGS. 1 and 2 schematically show a conventional Lysholm compressor. Intermeshing male and female rotors 1 and 2 are rotatably accommodated in a casing 3 with a plurality of helical thread crests 1a on the male rotor 1 being in mesh with a plurality of helical thread roots 2*a* on the female rotor 2. The rotors 1 and 2 are rotated in opposite directions indicated by arrows in FIGS. 1 and 2 so that a gas 4 is sucked at an axial end of the compressor, is compressed between the rotors 1 and 2 and is discharged through the other axial end of the compressor. The rotors 1 and 2 are supported at their respective shafts 5, 6 and 7, 8 extending from opposite axial ends of the rotors 1 and 2, by the casing 3 through bearings 9, 10 and 11, 12, respectively.

Gas compression efficiency in such Lysholm compressor is extremely greatly affected by inter-lobe clearance C1 between the rotors 1 and 2; by tip clearance C2 between the casing 3 and outermost peripheries of the rotors 1 and 2; by discharge-side end clearance C3 between the casing 3 and discharge-side end faces 1*x* and 2*x* of the rotors 1 and 2; and by suction-side end clearance C4 between the casing 3 and suction-side end faces 1*y* and 2*y* of the rotors 1 and 2. It is therefore very important to properly set or select these clearances C1, C2, C3 and C4.

The clearances C1, C2, C3 and C4 are not of simple nature and cannot be uniformly set or selected from mechanical size relationship. In the Lysholm compressors, consideration must be taken to a demand for decreasing the discharge-side end clearance C3 as small as possible because of the gas 4 from suction-side end faces of the rotors being gradually compressed to have highest pressure at the discharge end; to thermal expansions of the rotors 1 and 2 caused by the heat resulting from the compression of the sucked gas 4; and to plays of the bearings 9, 10, 11 and 12 in radial and thrust directions. Bearing in mind all of these, clearance distribution must be set or selected to optimize the compression efficiency.

The present invention was made to overcome the above and has for its object to provide a Lysholm compressor in which the above-mentioned clearances can be properly set or selected.

BRIEF SUMMARY OF THE INVENTION

In a Lysholm compressor having intermeshing male and female rotors rotatably accommodated in a casing, a plurality of helical thread crests on the male rotor being in mesh with a plurality of helical thread roots on the female rotor, whereby upon rotation of the rotors a gas is sucked at an axial end of the compressor, is compressed between the rotors and is discharged through the other axial end of the compressor, the present invention provides an improvement which comprises discharge-side bearings for bearing discharge-side shafts of the rotors to fix said discharge-side shafts in thrust direction and suction-side bearings for bearing suction-side shafts of the rotors to allow said suction-side shafts to move in the thrust direction.

According to this structure, when temperature at the discharge side of the compressor rises due to gas compression and the rotors are axially thermally expanded, thermal expansions of the rotors are prevented at the discharge side and permitted at the suction side. It follows therefore that in setting or selecting a discharge-side clearance between the casing and discharge-side end faces of the rotors, it suffices to take into consideration extremely slight thermal expansions and inherent plays of the discharge-side bearings in the thrust direction. As a result, it becomes possible to make the discharge-side clearance extremely small.

Then, a suction-side clearance between the casing and suction-side end faces of the rotors must be relatively great since the discharge-side clearance is extremely small and most of the thermal expansion of the rotors has to be undertook by the suction-side clearance. However, such relatively great suction-side clearance will hardly adversely affect on gas compression efficiency since the gas pressure at the suction side is lower than that at the discharge side due to the gas compression being not in progress at the suction side and since axial thermal expansions of the rotors will compensate the suction-side clearance into properly reduced clearance.

Generally, inherent plays of bearings in radial direction is smaller those in thrust direction. Therefore, not only inter-lobe clearance between the rotors but also tip clearance between the casing and outermost peripheries of the rotors may be made further smaller than the discharge-side clearance.

The discharge-side bearings may be formed at their outer peripheries with circumferentially extending grooves; the casing which surrounds the discharge-side bearings may be formed at its inner surface with grooves in opposed relationship with the grooves of the discharge-side bearings; and cured resin sections may be in spaces defined by the grooves. Then, even when the temperature at the discharge side rises due to the gas compression and thermal expansion difference occurs between the casing and the discharge-side bearings, movement of the discharge-side bearings in the radial direction is positively prevented by expansion of the resin which has higher coefficient of thermal expansion. Because of the resin being fitted into the spaces defined by the grooves and being in expansion in the thrust direction, movement of the discharge-side bearings in the thrust direction can be also positively prevented. As a consequence, the discharge-side bearings can be securely maintained both in the radial and thrust directions.

The present invention will become more apparent from the following description of a preferred embodiment thereof taken in conjunction with the accompanying drawings.

BRIEF DESCRIPTION OF THE DRAWINGS

The same reference numerals are used to designate similar parts throughout the figures.

DETAILED DESCRIPTION OF THE PREFERRED EMBODIMENT

Figure 3:
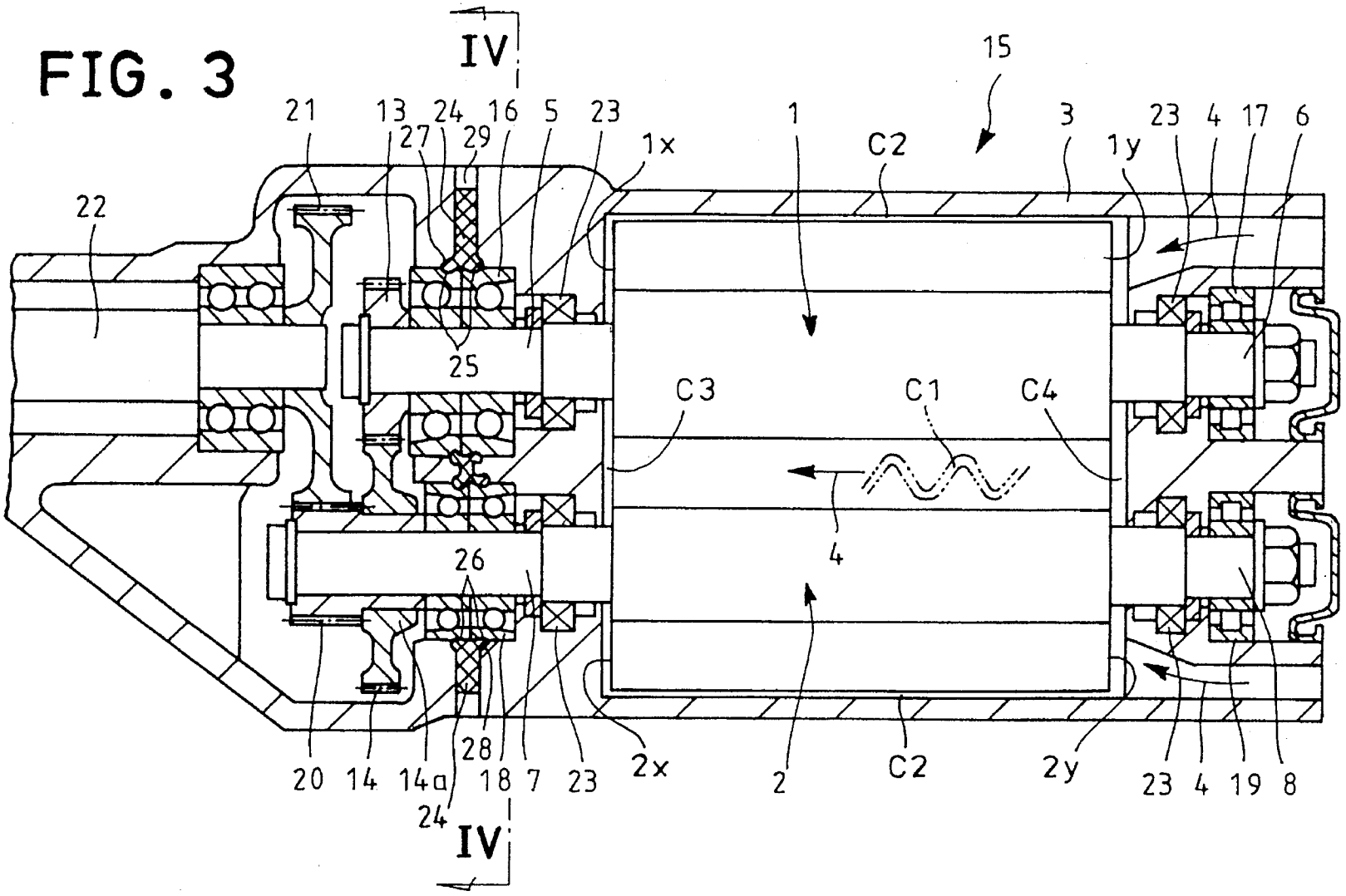
FIG. 3 is a sectional view showing a preferred embodiment of the present invention.
Figure 4:
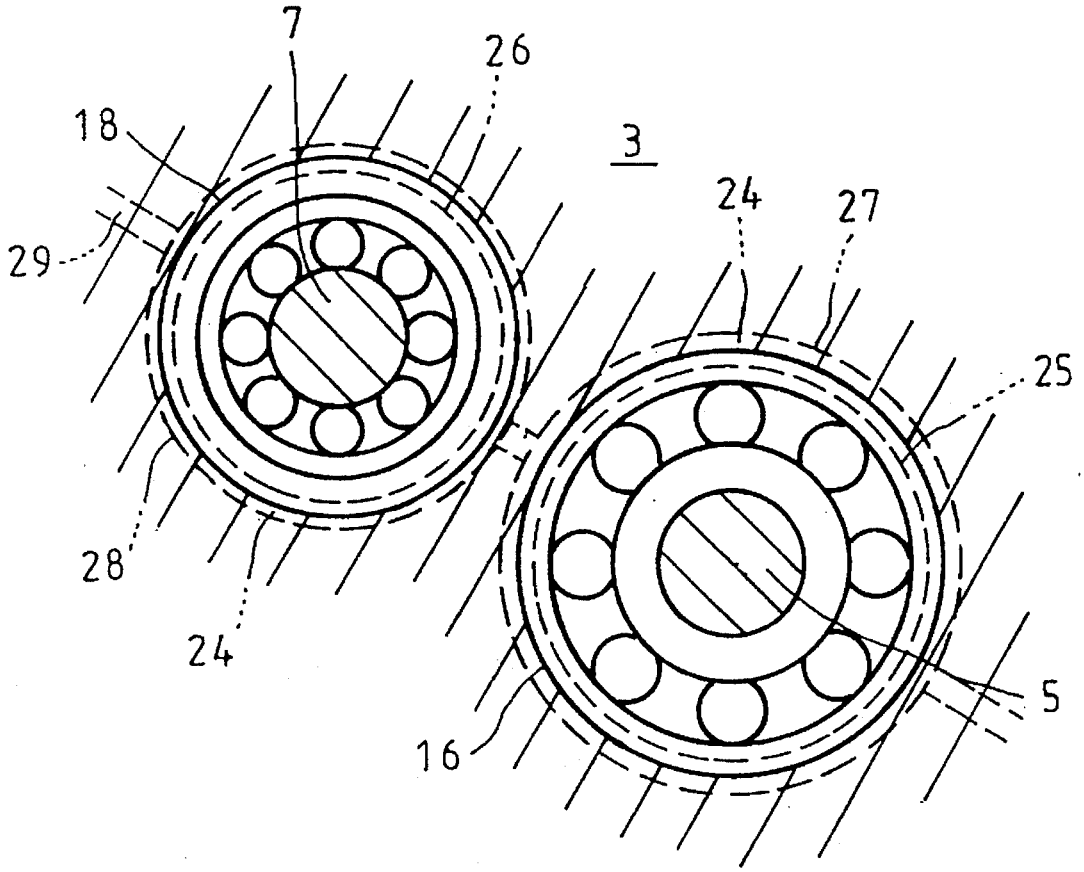
FIG. 4 is a view looking in the direction indicated by the arrows IV—IV in FIG. 3.
Figure 5:
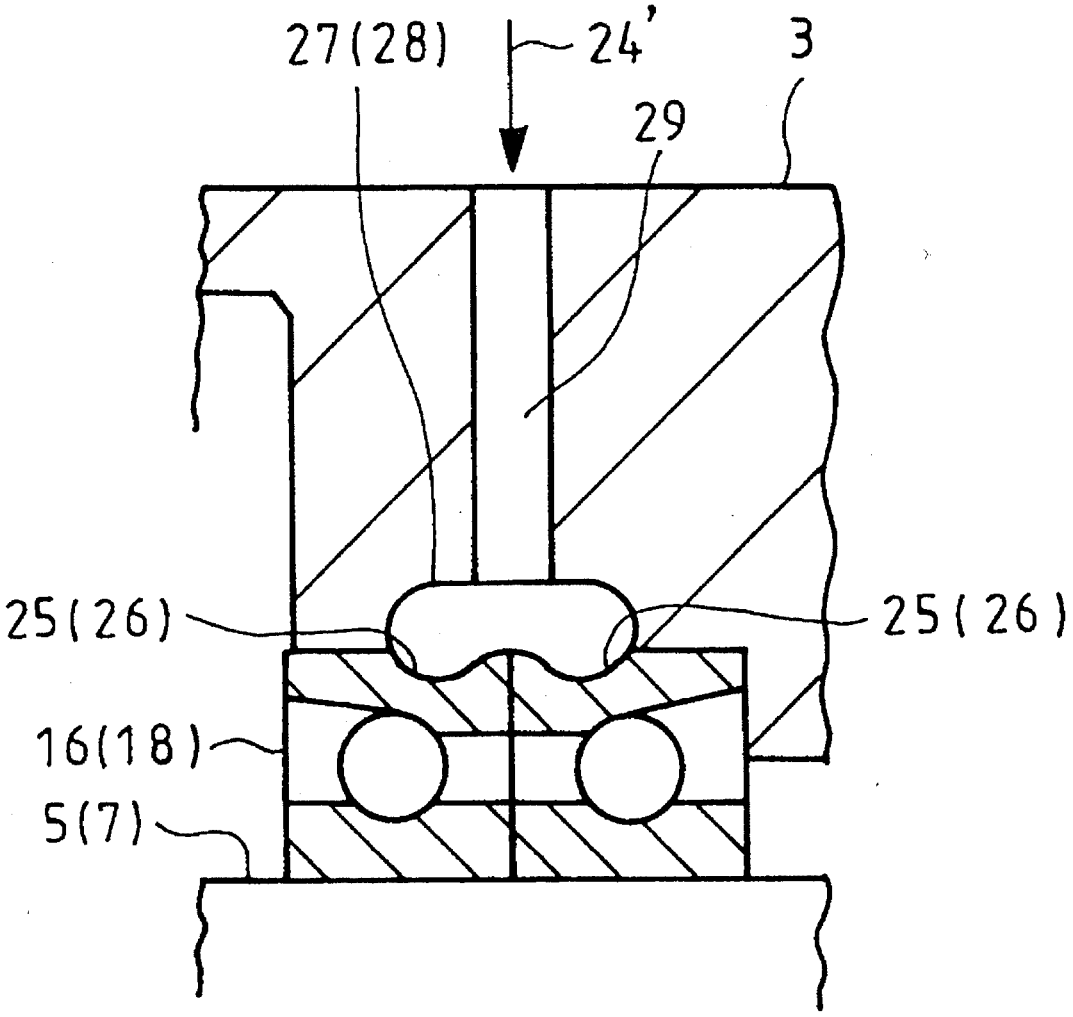
FIG. 5 is a sectional view on an enlarged scale illustrating grooves on the bearings and on the casing at the discharge side.

Referring now to FIGS. 3 to 5, a preferred embodiment of the present invention will be described in detail.

Figure 1:
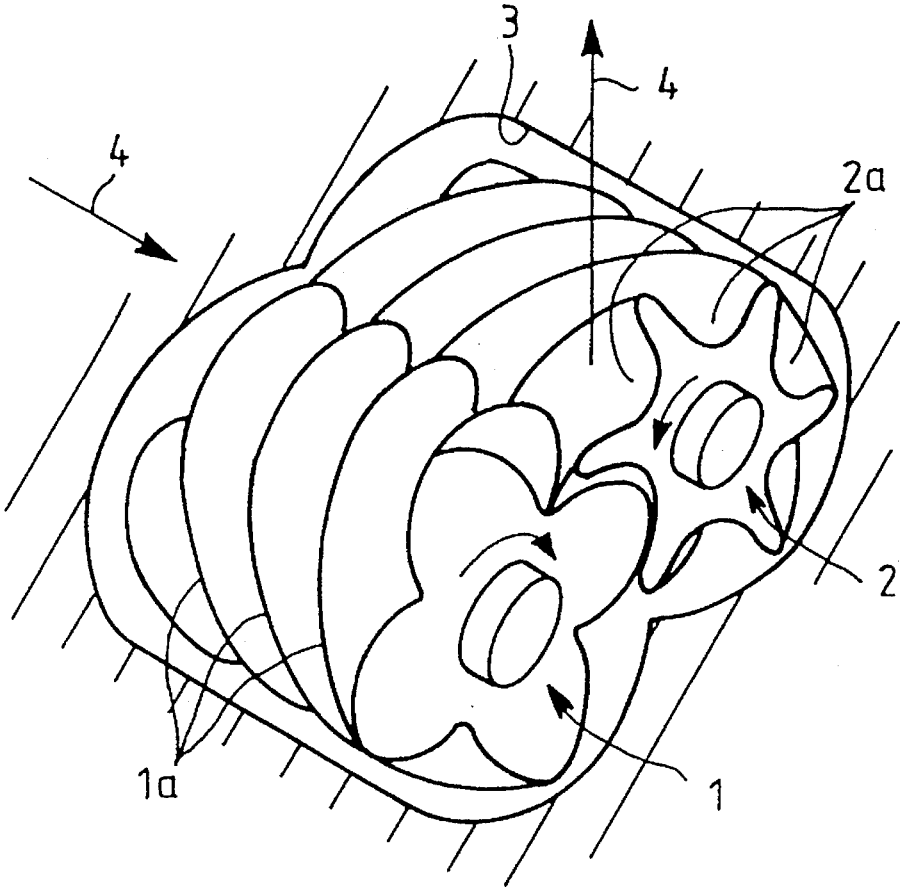
FIG. 1 PRIOR ART
FIG. 1 is a schematic perspective view of a conventional Lysholm compressor.
Figure 2:
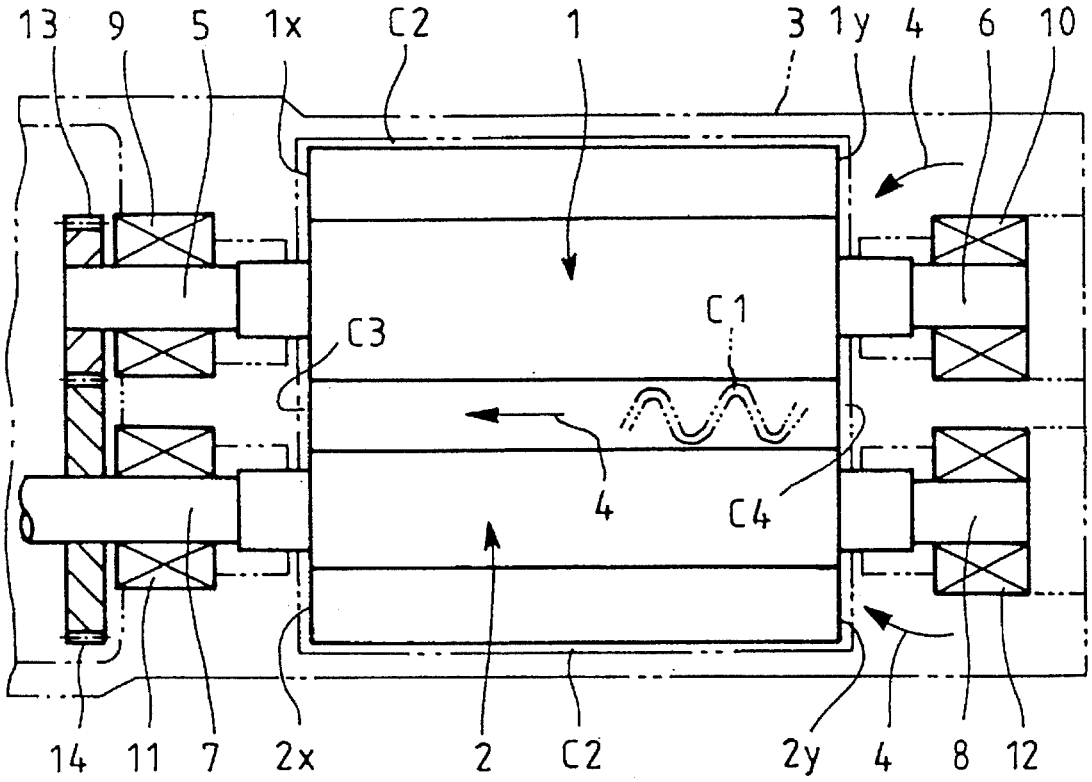
FIG. 2 PRIOR ART
FIG. 2 is a schematic top view thereof.

Reference numeral 15 generally designates a Lysholm compressor. Just like the conventional Lysholm compressor as shown in FIGS. 1 and 2, the intermeshing male and female rotors 1 and 2 are rotatably accommodated in the casing 3. By rotating the rotors 1 and 2, the gas 4 is sucked from the one axial end (on the right side in FIG. 3) of the compressor 15, is compressed between the rotors 1 and 2 and is discharged through a discharge port (not shown) at the other axial end (on the left side in FIG. 3) of the compressor 15. The rotors 1 and 2 are rotatably supported at their respective shafts 5, 6 and 7, 8 by the casing 3 through bearings 16, 17 and 18, 19, respectively.

The discharge-side bearings 16 and 18 are back-to-back connected paired angular contact ball bearings capable of fixing the shafts 5 and 7 in the thrust direction. The suction-side bearings 17 and 19 are cylindrical roller bearings to allow the shafts 6 and 8 to move in the thrust direction. Therefore, axial thermal expansions of the rotors 1 and 2 are prevented at the discharge side and are permitted at the suction side.

For co-rotation of the rotors 1 and 2 at a predetermined ratio, timing gears 13 and 14 are respectively shrinkage-fitted over the discharge-side shafts 5 and 7 of the rotors 1 and 2 and intermesh with each other. The female rotor 2 is torque-transmitted from an input shaft 22 through an acceleration pinion 20 fitted over the discharge-side shaft 7 and an acceleration wheel 21 in mesh with the gear 20.

Reference numeral 23 denotes mechanical seals for the shafts 5 and 6.

When the input shaft 22 is driven to rotate, its rotation is accelerated and transmitted by the wheel 21 and pinion 20 to the rotor 2. Then, the rotation accelerated and transmitted to the rotor 2 is further accelerated and transmitted through the timing gears 14 and 13 to the rotor 1. Thus, the rotors 1 and 2 are co-rotated at a predetermined ratio.

In this case, temperature at the discharge side rises due to the gas compression and the rotors i and 2 are axially thermally expanded, but the thermal expansions of the rotors 1 and 2 are prevented at the discharge side and are permitted at the suction side. It follows therefore that in setting or selecting the discharge-side clearance C3 between the casing 3 and the discharge-side end faces 1*x* and 2*x* of the rotors 1 and 2, it suffices to take into consideration extremely slight thermal expansions and inherent plays of the discharge-side bearings 16 and 18 in the thrust direction. As a result, it becomes possible to make the clearance C3 extremely small.

Then, the suction-side clearance C4 between the casing 3 and the suction-side end faces 1*y* and 2*y* of the rotors 1 and 2 must be relatively great since the discharge-side clearance C3 is extremely small and most of the thermal expansion of the rotors 1 and 2 has to be undertook by the clearance C4. However, such relatively great suction-side clearance C4 will hardly adversely affect on gas compression efficiency since the gas pressure at the suction side is lower than that at the discharge side due to the gas compression being not in progress at the suction side and since axial thermal expansions of the rotors 1 and 2 will compensate the clearance C4 into properly reduced clearance.

Generally, inherent plays of bearings in radial direction is smaller those in thrust direction. Therefore, not only the inter-lobe clearance C1 between the rotors 1 and 2 but also the tip clearance C2 between the casing 3 and the outermost peripheries of the rotors 1 and 2 may be made further smaller than the clearance C3.

As described above, according to the present invention, the axial thermal expansions of the rotors 1 and 2 are prevented at the discharge side and are permitted at the suction side, which makes it possible to properly set or select the clearances C1, C2, C3 and C4 without unnecessarily increasing the same. Especially, the clearance C3 at the discharge side where the compressed gas has a high pressure can be made extremely smaller, which remarkably enhances the compression efficiency.

Generally, in a Lysholm compressor as described above, the casing 3 may be made from a relatively light metal such as aluminum for reduction in weight of the compressor as a whole while the bearings 16, 17, 18 and 19 of the rotors 1 and 2 may be made from relatively rigid metal such as steel from the viewpoint of strength. Then, there is a fear that rise of temperature at the discharge side due to the gas compression may cause gaps to appear between the casing and the discharge-side bearings 16 and 18 due to difference in coefficient of thermal expansion therebetween, resulting in a problem that stabilized installation of the bearings 16 and 18 cannot be maintained both in the radial and thrust directions. Then, in setting or selecting the clearances C1, C2, C3 and C4, consideration must be taken also to possible plays of the bearings 16 and 18 due to the difference in thermal expansion between the casing and the bearings 16 and 18.

This problem is reasonably averted by the embodiment of the present invention in which, as best shown in FIG. 5, the discharge-side bearings 16 and 18 in the form of back-to-back connected angular contact ball bearing pair are formed at their mutually adjacent paired outer peripheries with circumstantially extending grooves 25 and 26, respectively. The casing 3 which surrounds the bearings 16 and 18 is formed at its inner surface with grooves 27 and 28 in opposed relationship with the grooves 25 and 26, respectively, and injecting passages 29 are formed through the casing 3 through which passages 29 molten resin 24' is injected into spaces defined by the grooves 25, 26, 27 and 28 and is cured, whereby cured resin sections 24 are defined. Therefore, even when the temperature at the discharge side rises due to the gas compression and thermal expansion difference occurs between the casing 3 and the discharge-side bearings 16 and 18, movement of the bearing 16 and 18 in the radial direction is positively prevented by expansion of the resin which has coefficient of thermal expansion higher than that of, for example, aluminum. In a similar manner, movement of the bearings 16 and 18 in the thrust direction can be positively prevented. As a consequence, the bearings 16 and 18 can be securely maintained both in the radial and thrust directions.

Since the discharge-side bearings 16 and 18 are securely retained in their predetermined positions, respectively, in a stable manner as described above, it is no longer necessary to take into consideration any plays of the bearings 16 and 18 due to the difference in thermal expansion with respect to the clearances C1, C2, C3 and C4. As a result, the clearances C1, C2, C3 and C4 can be properly set or selected in the manner described hereinbefore and furthermore any vibration of the bearings 16 and 18 due to the plays resulting from the difference in thermal expansion can be also prevented.

According to the present embodiment, back-to-back connected paired angular contact ball bearings are used as the discharge-side bearings 16 and 18 and the grooves 25 and 26 on the bearings 16 and 18 are respectively interconnected in the thrust direction by the resin sections 24, which contributes to preventing the paired angular contact ball bearings from being separated.

It is to be understood that the present invention is not limited to the above-mentioned embodiment and that various modifications may be effected without leaving the true spirit of the present invention. For example, the back-to-back connected paired angular contact ball bearings as the discharge-side bearing may be replaced by an integral duplex angular contact ball bearing. The number of the groove on each of the discharge-side bearings is not limited to one and two or more grooves may be formed on each of the discharge-side bearings as needs demand.

What is claimed is:

1. In a Lysholm compressor having intermeshing male and female rotors rotatably accommodated in a casing, a plurality of helical thread crests on the male rotor, whereby upon rotation of said rotors a gas is sucked at an axial end of the compressor, is compressed between said rotors and is discharged through the other axial end of the compressor, an improvement which comprises discharge-side bearings for bearing discharge-side shafts of said rotors to fix said discharge-side shafts in a thrust direction and suction-side bearings for bearing suction-side shafts of said rotors to allow said suction-side shafts to move in the thrust direction, wherein said discharge-side bearings are formed at outer peripheries thereof with circumferentially extending grooves, said casing being formed at an inner surface thereof with grooves in opposed relationship with the grooves of said discharge-side bearings, cured resin sections being in a space defined by said grooves.

2. The compressor according to claim 1 wherein said discharge-side bearings are angular contact ball bearings and said suction-side bearings are cylindrical roller bearings.

3. The compressor according to claim 1 wherein injection passages are formed through the casing so as to inject molten resin into the spaces defined by said grooves.

4. The compressor according to claim 2 wherein injection passages are formed through the casing so as to inject molten resin into the spaces defined by said grooves.

5. In a lysholm compressor having intermeshing male and female rotors rotatably accommodated in a casing, a plurality of helical thread crests on the male rotor being in mesh with a plurality of helical thread roots on the female rotor, whereby upon rotation of said rotors, a gas is sucked from one axial end of said casing, compressed between said rotors and is discharged from the other axial end of said casing, an improvement which comprises circumferentially extending grooves on outer peripheries of discharge-side bearings, grooves on an inner surface of said casing in opposed relationship with the grooves of said discharge-side bearings and cured resin sections in spaces defined by said grooves.

6. The compressor according to claim 5 wherein injection passages are formed through the casing so as to inject molten resin into the spaces defined by said grooves.

* * * * *